US008294353B1

(12) United States Patent
Sajó et al.

(10) Patent No.: US 8,294,353 B1
(45) Date of Patent: Oct. 23, 2012

(54) LIGHTING APPARATUS HAVING BARRIER COATING FOR REDUCED MERCURY DEPLETION

(75) Inventors: Gábor Sajó, Budapest (HU); István Károly Deme, Budapest (HU); Ottokár Gyulasi, Budapest (HU); Gabriella Révész, Dunakeszi (HU); Géza István Szeghy, Dunakeszi (HU)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/217,656

(22) Filed: Aug. 25, 2011

(51) Int. Cl.
*H01J 1/62* (2006.01)

(52) U.S. Cl. ..... 313/489; 313/635

(58) Field of Classification Search ..... 313/489, 313/635
See application file for complete search history.

(56) References Cited

U.S. PATENT DOCUMENTS

| | | | |
|---|---|---|---|
| 5,258,689 | A | 11/1993 | Jansma et al. |
| 5,539,277 | A | 7/1996 | Jansma |
| 5,602,444 | A | 2/1997 | Jansma |
| 6,369,502 | B1 | 4/2002 | Auber et al. |
| 6,841,939 | B2 | 1/2005 | Scott et al. |
| 6,952,081 | B1 | 10/2005 | Jansma et al. |
| 7,427,829 | B2 | 9/2008 | Deme et al. |
| 2009/0079324 | A1 | 3/2009 | Deme et al. |

FOREIGN PATENT DOCUMENTS

| | | | |
|---|---|---|---|
| WO | 2007034997 | A2 | 3/2007 |

*Primary Examiner* — Vip Patel
(74) *Attorney, Agent, or Firm* — GE Global Patent Operation; Peter T. DiMauro

(57) ABSTRACT

Embodiments of a lighting apparatus comprise a barrier coating with multiple layers. Each layer comprises metal oxide particles such as gamma alumina particles and alpha alumina particles. In one embodiment, the barrier coating comprises a first layer that reduces mercury depletion and a second layer that improves opacity.

18 Claims, 3 Drawing Sheets

A-A

LIGHTING APPARATUS HAVING BARRIER COATING FOR REDUCED MERCURY DEPLETION

BACKGROUND

The subject matter of the present disclosure relates to lighting and lighting devices and, more particularly, to embodiments of a lighting device (e.g., fluorescent lamps) that utilize a multi-layer barrier coating to reduce depletion of mercury.

Fluorescent lamps use an electric discharge to excite mercury vapor and cause a material to luminesce and emit visible light. Unfortunately, mercury often reacts with the luminescing material and with the lamp structure, e.g., the glass tube that houses the mercury vapor. These reactions deplete the quantity of mercury. Fluorescent lamps that use lower levels of mercury (e.g., less than about 3 mg/lamp in 1200 mm (e.g., 48 inches) linear fluorescent lamp) are more susceptible to mercury depletion. These lamps are becoming more common because the lower levels of mercury are more environmentally friendly and, accordingly, more attractive to consumers.

To reduce the rate that mercury depletes, some fluorescent lamps provide a chemically inert barrier that prevents reaction of the mercury and the glass tube. Changes in materials, designs, and manufacturing may, however, adversely affect features of the fluorescent lamp. For example, although certain compositions of the barrier may prevent mercury absorption, the resulting lamp does not have the aesthetic appeal because the barrier does not provide a level of opacity that appeals to consumers.

BRIEF SUMMARY OF THE INVENTION

The present disclosure describes embodiments of a lighting apparatus that includes a barrier coating that inhibits mercury depletion. Unlike other fluorescent lamps, however, the barrier coating comprises multiple layers with properties that can individually modify certain features of the resulting apparatus. For example, one layer of the barrier coating may prevent mercury depletion, while another layer changes the level of opacity of the lighting apparatus.

In one embodiment, a lighting apparatus comprises an envelope having an inner surface and comprising a light-transmissive material. The lighting apparatus also comprises a coating disposed on the inner surface, the coating comprising a barrier coating having particles comprising metal oxide, the barrier coating forming a first layer and a second layer. In one example, the particles of the first layer have a specific surface area that is greater than the specific surface area of the particles in the second layer.

In another embodiment, a lamp comprises an envelope having a hermetically-sealed inner volume with an inner surface. The lamp also comprises a barrier coating disposed on the inner surface, the barrier coating comprising a first layer of metal oxide particles having a specific surface area that is from about 40 $m^2/g$ or greater and a second layer of metal oxide particles having a specific surface area from about 5 $m^2/g$ to about 40 $m^2/g$. The lamp further comprises a luminescent coating disposed on the barrier coating.

In yet another embodiment, a lighting apparatus comprises an envelope and a barrier coating disposed on an inner surface of the tube, the barrier coating comprising gamma alumina particles and predominantly alpha alumina particles residing in different layers of the barrier coating.

Other features and advantages of the disclosure will become apparent by reference to the following description taken in connection with the accompanying drawings.

BRIEF DESCRIPTION OF THE DRAWINGS

Reference is now made briefly to the accompanying drawings, in which.

Where applicable like reference characters designate identical or corresponding components and units throughout the several views, which are not to scale unless otherwise indicated.

DETAILED DESCRIPTION OF THE INVENTION

As used herein, an element or function recited in the singular and proceeded with the word "a" or "an" should be understood as not excluding plural said elements or functions, unless such exclusion is explicitly recited. Furthermore, references to "one embodiment" of the claimed invention should not be interpreted as excluding the existence of additional embodiments that also incorporate the recited features.

Figure 1:
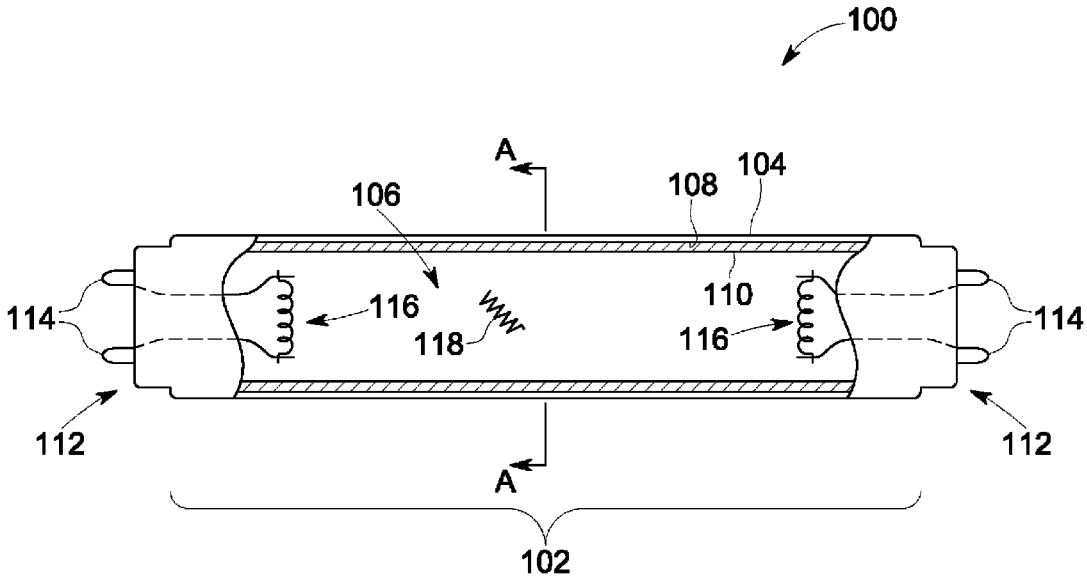
FIG. 1 depicts a side view, in partial section, of an exemplary embodiment of a lighting apparatus.
Figure 2:
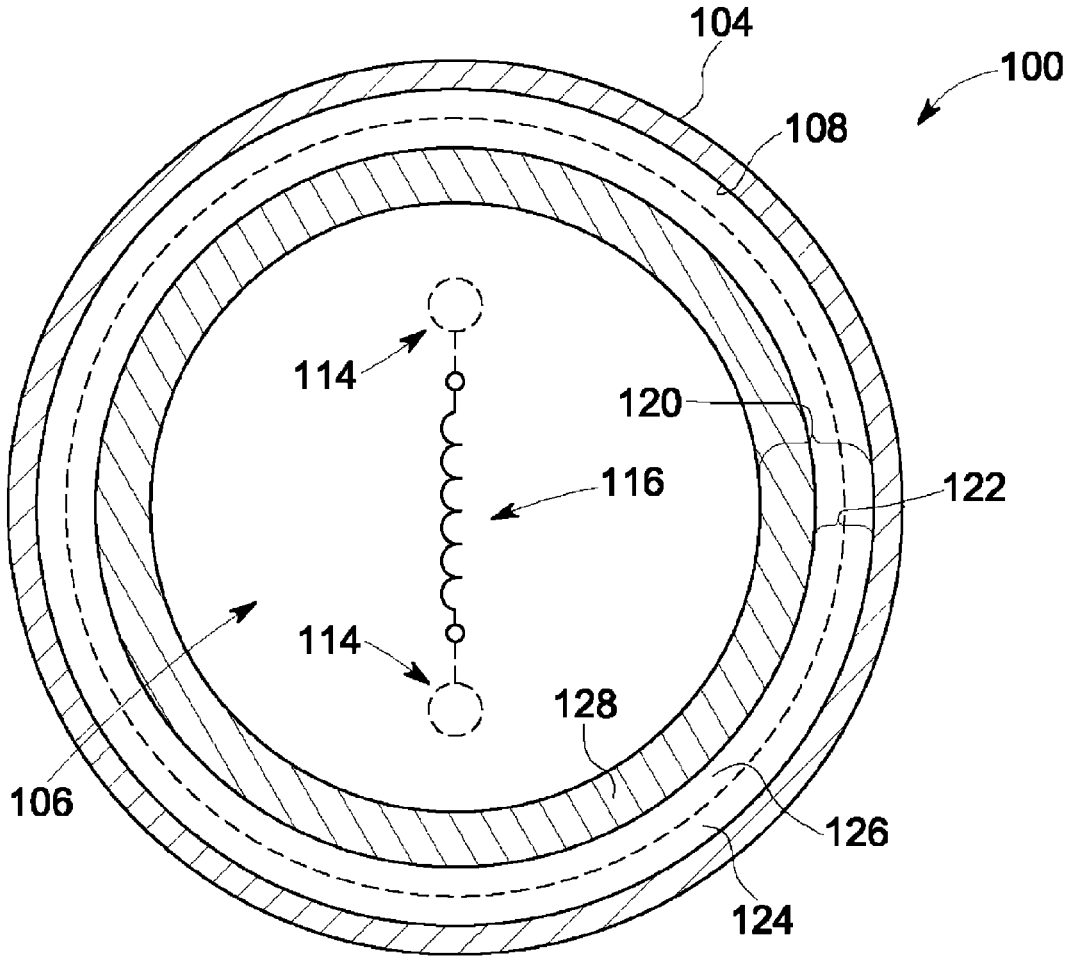
FIG. 2 depicts a cross-section of the lighting apparatus of FIG. 1.

FIGS. 1 and 2 illustrate an exemplary embodiment of a lighting apparatus 100 that is configured for reduced mercury consumption. FIG. 1 depicts a side view of the lighting apparatus 100 with a partial cut-away that provides a view of the structure inside. FIG. 2 shows a cross-section of the lighting apparatus taken along line A-A of FIG. 1.

Examples of the lighting apparatus 100 include a "fluorescent lamp." which is any type of mercury vapor discharge fluorescent lamp as known in the art. Fluorescent lamps can include fluorescent lamps having electrodes as well as electrodeless lamps, wherein the means to provide discharge may include a radio transmitter adapted to excite mercury vapor atoms via transmission of an electromagnetic signal. Moreover, embodiments of the lighting apparatus 100 can embody particular types of fluorescent lamps such as T5, T8, T10, and compact fluorescent ("CFL") lamps. One popular type of fluorescent lamp is a T8 lamp, for example, which is preferably linear, having a nominal length close to 1200 mm (e.g., 48 inches), and a nominal outer diameter of 25 mm (e.g., 1 inch).

As shown in the exemplary embodiment of FIG. 1, the lighting apparatus 100 comprises a tubular structure 102 with an envelope 104 that forms an interior volume 106. The envelope 104 has an inner surface 108 on which a coating 110 resides. The lighting apparatus 100 also comprises one or more discharge elements 112, which can include contact pins 114 and electrode structures 116 that generate an electrical discharge. The discharge elements 112 can hermetically seal the interior volume 106 to maintain a gas-fill material 118 inside of the tubular structure 102. The gas-fill material 118 may comprise mercury vapor in combination with one or more inert and/or noble gases at low pressure (e.g., from about 1 torr to about 4 torr). The inert gases may comprise, for example, one or more of argon, krypton, neon, and mixtures thereof. In one embodiment, the mercury vapor originates from mercury amalgam disposed in the lighting apparatus 100 such as proximate one or more of the discharge elements 112.

The envelope 104 may comprise glass or other light-transmissive material. Soda-lime glass is an example and one common type of glass for use in embodiments of the lighting apparatus 100. However, the composition of soda lime glass and other materials may attract atoms in the gas-fill material. For example, when mercury vapor fills the interior volume, sodium ions in the soda lime glass causes mercury to absorb into the envelope 104. Absorption of mercury into the envelope 104 reduces the amount of mercury available to generate light.

As best shown in FIG. 2, to address this problem the coating 110 described in the context of FIG. 1 may comprise a layered structure 120. In one embodiment, the layered structure 120 has a barrier coating 122 that comprises a first layer 124 and a second layer 126. The layered structure 120 also has a luminescent coating 128 that comprises phosphor materials (e.g., rare earth triphosphor, triphosphor mixtures, halophosphate-type phosphors, etc.) and like materials that absorb UV light and emit visible light as are known in, e.g., the fluorescent lamp art.

The barrier coating 122 may prevent and/or inhibit absorption of mercury atoms into the envelope 104. The barrier coating 122 may also provide favorable levels of opacity (or optical density) for the envelope 104 that can reduce the transparency of the envelope 104 and improve the appearance of the lighting apparatus 100. In one example, the barrier coating 122 causes the envelope 104 to appear opaque white when observed from outside, i.e., looking into the interior volume 106 from outside the envelope 104. The barrier coating 122 may also beneficially reflect ultraviolet (UV) light back into the luminescent coating 128, leading to improved phosphor utilization and more efficient production of visible light.

The barrier coating 122 can comprise inert metal oxides such as aluminum oxides. Other metal oxides may include oxides of yttrium, titanium, zirconium, hafnium, niobium, tantalum, lanthanum, or combinations thereof. Examples of the barrier coating 122 may be substantially non-mercury absorptive, which means that mercury would not substantially absorb into the barrier coating 122 when the lighting apparatus 100 is active (e.g., the discharge elements 112 are energized) or not active.

Layers (e.g., the first layer 124 and/or the second layer 126) of the barrier coating 122 can comprise particles of inert metal oxides with a specific surface area that is relatively higher than other layers (e.g., the first layer 124 and/or the second layer 126) in the barrier coating 122. For example, particles in one layer may have a specific surface area of about 80 $m^2/g$, although in other examples the specific surface area can be from about 40 $m^2/g$ to about 150 $m^2/g$, and/or greater than about 40 $m^2/g$. Comparatively, the specific surface area of another layer may be about 25 $m^2/g$, from about 5 $m^2/g$ to about 40 $m^2/g$, and/or less than about 40 $m^2/g$.

The layers of the barrier coating 122 may comprise a type of metal oxide particle that is different from the type of metal oxide that is found in other layers of the barrier coating 122. For example, one layer may comprise metal oxide particles of a first type and another layer may comprise metal oxide particles of a second type. The layers may comprise predominantly (e.g., over about 60% by weight) one type of metal oxide particles. As discussed below, the barrier coating 122 may comprise a layer with gamma alumina particles but no alpha alumina particles and a layer with alpha alumina particles and optionally some gamma alumina particles. It is noted, however, that these embodiments do not foreclose compositions of the barrier coating 122 that comprise layers in which blends and/or mixtures of various types of metal oxide particles are found. That is, in embodiments of the lighting apparatus 100, layers of the barrier coating 122 may comprise various types of particles (e.g., metal oxide particles) that cause the layers to exhibit one or more of the features contemplated herein.

In one embodiment, the first layer 124 comprises gamma alumina particles and the second layer 126 comprises predominantly alpha alumina particles. The gamma alumina particles can form a dense, compact coating, which inhibits interaction between the mercury vapor and the underlying material of the envelope 104. Gamma alumina particles can be found in Aeroxide Alu C, which is a high purity, low alkali content, colloidal alumina of submicron particle size dispersible in water and available from the EVONIK Company. After dispersion in aqueous media, Aeroxide Alu C can have a median particle diameter of about 0.2 μm, with the total particle size distribution broadly ranging from about 0.07 μm to about 1 μm, and with 90% of the total distribution occurring (on a measured sample) of less than about 0.5 μm.

The position of the layers can vary, wherein the first layer 124 can reside proximate the inner surface 108 as shown in FIG. 2. In other examples, the second layer 126 can reside proximate the inner surface 108 and the first layer 124 can be disposed thereon. Generally the luminescent coating 128 resides on top of the barrier portion 122 to facilitate interaction of the phosphor material and the UV generated in the discharge. In one or more embodiments, the barrier coating 122 may include layers in addition to the first layer 124 and the second layer 126. Likewise such embodiments may comprise additional coatings and materials that are used in conjunction with or in substitute of one or more of the barrier coating 122 and the luminescent coating 128.

The "thickness" (sometimes also referred to as "loading") of the layers can cause the lighting apparatus 100 to exhibit certain features. Changes to these features can occur in response to changes to the thickness in both the barrier coating 122 (e.g., the first layer 124 and the second layer 126) and the luminescent coating 128. Generally the thickness of the luminescent coating 128 is about 1.5 $mg/cm^2$ to about 6.0 $mg/cm^2$. The thickness of the first layer 124 and the second layer 126 can determine the relative mercury consumption and opacity of the lighting apparatus 100. The thickness of the layer with the gamma alumina particles (e.g., the first layer 124) can be from about 0.01 $mg/cm^2$ to about 0.30 $mg/cm^2$ and, in one embodiment of the lighting apparatus 100 the thickness is about 0.04 $mg/cm^2$. The thickness of the layer with the predominantly alpha alumina particles (e.g., the second layer 126) can be from about 0.2 $mg/cm^2$ to about 1.0 $mg/cm^2$ and, in one embodiment, the thickness of the second layer 126 is about 0.3 $mg/cm^2$.

Figure 3:
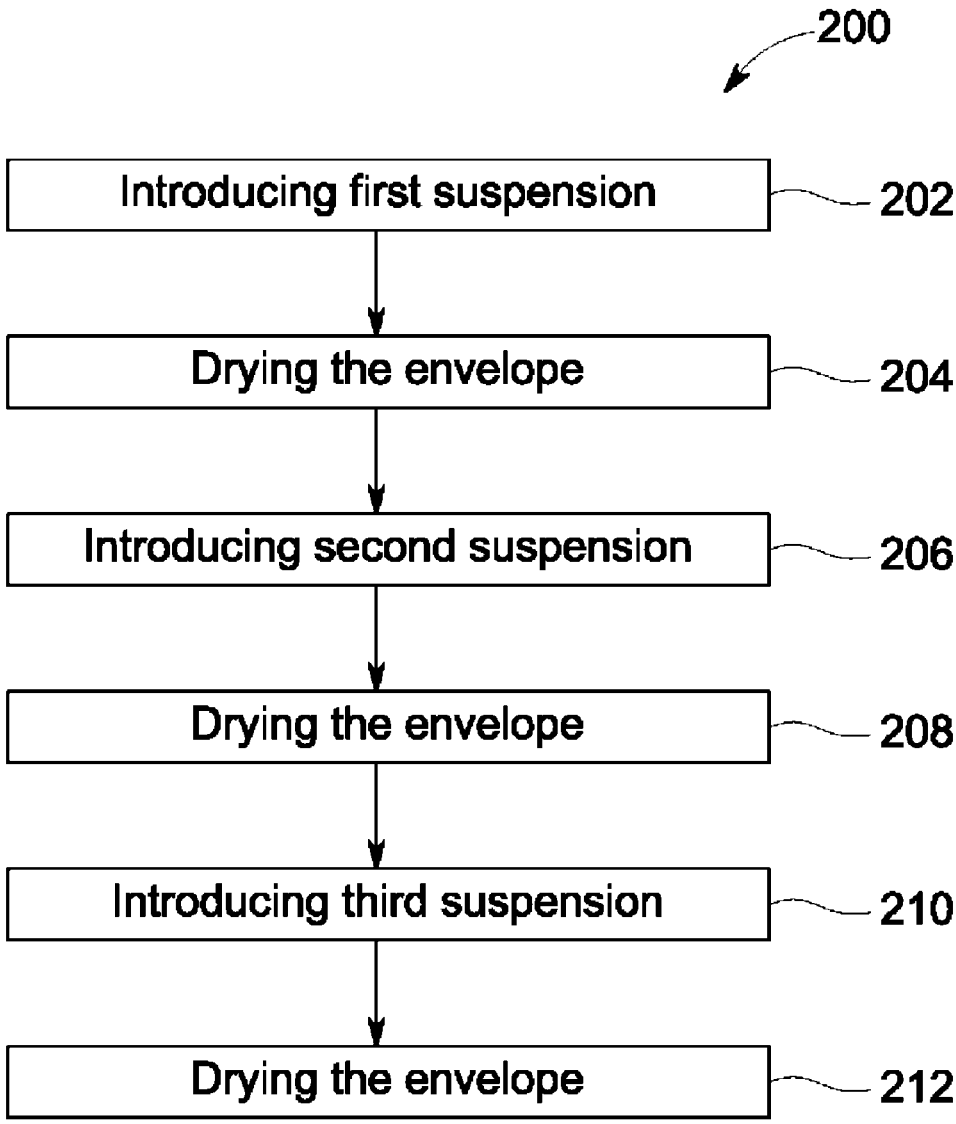
FIG. 3 depicts a flow diagram of an exemplary embodiment of a method to form a coating on an element of a lighting apparatus such as the lighting apparatus of FIGS. 1 and 2.

FIG. 3 depicts a flow diagram of an exemplary embodiment of a method 200 to form the coating 110 on the envelope 104. Known techniques for applying coatings to the inner surface 106 of the envelope 104 include flushing a liquid-based suspension through the envelope 104 as well as dispersing, spraying, and by electrostatic methods. In one example, a spray head (not shown) is inserted into one end of the envelope 104. The spray head is manipulated along the axial length so the tube is spray coated with the suspension. Other techniques may likewise be suited for use with embodiments of the lighting apparatus 100 of FIGS. 1 and 2 above and the method 200 that the disclosure presents below.

The method 200 comprises, at block 202, introducing the envelope to a first suspension and, at block 204, drying the envelope to form a first layer. The method 200 also comprises, at block 206, introducing the envelope to a second suspension and, at block 208, drying the envelope to form a second layer.

The method further comprises, at block 210, introducing the envelope to a third suspension and, at block 212, drying the envelope to form a third layer.

When using particles of gamma alumina and alpha alumina, the particles should generally be substantially pure or of high purity substantially without light-absorbing impurities or with a minimum of light-absorbing impurities. In one example, two separate alumina suspensions can be formulated, a first suspension comprising gamma alumina particles and a second suspension comprising predominantly alpha alumina particles. A third suspension comprising a suitable luminescent material (e.g., phosphor) can be formulated in accordance with composition and formulation known in the art.

Each suspension may comprise the alumina particles (e.g., the gamma alumina particles or the alpha alumina particles), which can be dispersed in a water vehicle with a dispersing agent such as ammonium polyacrvlate and/or other agents known in the art. In one embodiment, the first suspension for the gamma alumina particles is about 0.5 to about 8.0 weight percent alumina and about 0 to about 0.5 weight percent dispersing agent. The secpnd suspension comprising predominantly the alpha alumina particles is about 5 to about 12 weight percent alumina and 0.2 to about 0.5 weight percent dispersing agent.

The first suspension is then applied as a layer of the barrier coating (e.g., block 202) to the inside of the envelope 104 and heated and/or dried at from about 40° C. to about 120° C. The second suspension is then applied as a layer of the barrier coating (e.g., at block 206) to the inside of the envelope 104 and heated and/or dried at from about 40° C. to about 120° C. The third suspension is then applied as a luminescent coating (e.g., at block 208) to the inside of the envelope 104 and heated and/or dried from about 50° C. to about 120° C. In one embodiment, after the barrier coating and the luminescent coating have been coated and dried, the coated envelope 104 is baked by conventional means using the highest temperature the material of the envelope 104 allows (e.g., for glass, about 400° C. to about 600° C. for at least about 30 seconds at the peak temperature). Manufacture of embodiments of the lighting apparatus 100 continues in the usual way thereafter.

The following example further illustrates various aspects and embodiments of the present invention.

EXAMPLE

For purposes of example and to implement the subject matter of the discussion above, three suspensions were prepared and applied to an envelope, in this case a glass tube. A first slurry was prepared by mixing about 350 g of high purity colloidal gamma alumina with a specific surface area of about 100 $m^2/g$ (e.g., Aeroxide Alu C made by Evonik) with about 802 g of deionized water and 14 g of about 96% acetic acid. The first slurry was mixed with a propeller stirrer for about 10 minutes, ground in a bead mill for about 30 minutes using 1 mm zirconia beads, and filtered through a sieve of 20 μm hole size (e.g., 700 mesh). The first suspension was made by mixing 153 g of the first slurry, 846 g of deionized water, and 1.5 g of nonionic surfactant.

A second slurry was prepared by mixing 100 g of high purity alumina containing about 80% alpha-phase and 20% gamma-phase with a specific surface area of about 26 $m^2/g$ (e.g., Baikalox CR30F made by Baikowski) with about 300 g of deionized water. During continuous mixing by a propeller stirrer, 2.5 g concentrated ammonia, 1.8 g dispersant (e.g., Dispex A40), 120 g of 5% aqueous binder solution, and 2 g nonionic surfactant was mixed together. The second slurry was treated by high shear mixer (e.g., Kaddy Mill) and filtered through a sieve of 80 μm hole size to form the second suspension.

A third slurry was prepared by mixing (under continuous stirring) about 1000 g deionized water, 20 g monoethanolamine, 6 g dispersant (e.g., Dispex A40), 10 g colloidal gamma-alumina with a specific surface area of about 100 $m^2/g$, 555 g Europium-activated yttrium oxide red phosphor, 380 g cerium-terbium activated lanthanum phosphate green phosphor, 64 g Europium activated magnesium aluminate blue phosphor, 1000 g 5% aqueous solution of polyethylene oxide (e.g., Polyox WSR 3000), and 0.2 g nonionic surfactant. The third slurry was stirred for about 4 hours and filtered through a sieve of 100 μm hole size (e.g., 150 mesh) to form the third suspension.

A first lighting apparatus was made comprising a 1200 mm (e.g. 48 inches) glass tube with an outer diameter of 16 mm. The lighting apparatus comprised a barrier coating with a first layer formed by application of the first suspension onto the inner surface of the glass tube. The coating and drying process is well known to those in the art. A second layer was disposed on the first layer by application of the second suspension. A luminescent coating was disposed on the second layer by application of the third suspension.

A second lighting apparatus was made comprising a 1200 mm (e.g., 48 inches) glass tube with an outer diameter of 16 mm. The lighting apparatus comprised a barrier layer with a first layer formed by application of the first suspension onto the inner surface of the glass tube. A luminescent coating was disposed on the first layer by application of the third suspension.

A third lighting apparatus was made comprising a 1200 mm (e.g., 48 inches) glass tube with an outer diameter of 16 mm. The lighting apparatus comprised a barrier layer with a first layer formed by application of the second suspension onto the inner surface of the glass tube. A luminescent coating was disposed on the first layer by application of the third suspension.

Each of the first lighting apparatus, the second lighting apparatus, and the third lighting apparatus were tested for mercury consumption. According to the results, mercury consumption for the first lighting apparatus was measured at about 0.34 mg/lamp and 0.35 mg/lamp at about 9200 hours of burn time. Mercury consumption for the second lighting apparatus was measured at about 0.12 mg/lamp, 0.013 mg/lamp, and 0.11 mg/lamp (at 1024 hours of burn time); 0.18 mg/lamp and 0.19 mg/lamp (at 2974 hours of burn time); and 0.32 mg/lamp and 0.29 mg/lamp (at 5434 hours of burn time). Mercury consumption for the third lighting apparatus was measured at about 0.83 mg/lamp and 0.80 mg/lamp (at 10552 hours of burn time); 0.82 mg/lamp, 0.86 mg/lamp, and 0.71 mg/lamp (at 11008 hours of burn time); and 1.05 mg/lamp and 1.02 mg/lamp (at 12024 hours of burn time); and 0.77 mg/lamp (at 12504 hours of burn time).

The data collected and measured above can be used to extrapolate for longer burn time including burn time of about 30000 hours. Accordingly, when extrapolated for extended life, it is noted that mercury consumption for the first lighting apparatus is about 0.63 mg/lamp, for the second lighting apparatus is about 0.69 mg/lamp, and for the third lighting apparatus is about 1.40 mg/lamp.

This written description uses examples to disclose embodiments of the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A lighting apparatus, comprising:

an envelope having an inner surface and comprising a light-transmissive material; and a coating disposed on the inner surface, the coating comprising a barrier coating having particles comprising metal oxide, the barrier coating forming a first layer and a second layer, wherein the particles of the first layer have a specific surface area that is greater than the specific surface area of the particles in the second layer.

2. The lighting apparatus of claim 1, wherein the particles of the first layer comprise gamma alumina.

3. The lighting apparatus of claim 1, wherein the specific surface area of the particles in the first layer is from about 40 $m^2/g$ to about 150 $m^2/g$.

4. The lighting apparatus of claim 1, wherein the first layer is disposed on the inner surface of the envelope.

5. The lighting apparatus of claim 1, further comprising a luminescent coating disposed on the barrier coating.

6. The lighting apparatus of claim 1, wherein the envelope appears opaque at an exterior surface when illuminated therethrough.

7. The lighting apparatus of claim 1, wherein the thickness of the first layer is less than the thickness of the second layer.

8. The lighting apparatus of claim 1, wherein the particles of the second layer comprise predominantly alpha alumina.

9. A lamp, comprising:

an envelope having a hermetically-sealed inner volume with an inner surface;

a barrier coating disposed on the inner surface, the barrier coating comprising a first layer of metal oxide particles having a specific surface area that is from about 40 $m^2/g$ or greater and a second layer of metal oxide particles having a specific surface area from about 5 $m^2/g$ to about 40 $m^2/g$;

a gas fill material comprising mercury disposed in the volume; and a luminescent coating disposed on the barrier coating.

10. The lamp of claim 9, wherein the first layer comprises gamma alumina.

11. The lamp of claim 9, wherein the second layer comprises alpha alumina.

12. The lamp of claim 9, wherein second layer is disposed on the first layer and between the luminescent coating and the first layer.

13. The lamp of claim 9, wherein the first layer has a thickness of about 0.01 $mg/cm^2$ to about 0.3 $mg/cm^2$.

14. A lighting apparatus, comprising:

an envelope; and a barrier coating disposed on an inner surface of the tube, the barrier coating comprising gamma alumina particles and predominantly alpha alumina particles residing in different layers of the barrier coating.

15. The lighting apparatus of claim 14, wherein the envelope appears opaque at an exterior surface when illuminated therethrough.

16. The light apparatus of claim 14, wherein the layer with predominantly alpha alumina particles has a thickness that effectively reflects and scatters visible light.

17. The lighting apparatus of claim 14, wherein the layer with the gamma alumina particles resides proximate the inner surface.

18. A lamp, comprising:

an envelope having a hermetically-sealed inner volume with an inner surface;

a barrier coating disposed on the inner surface, the barrier coating comprising a first layer comprising aluminum oxide particles having a specific surface area that is from about 40 $m^2/g$ or greater and a second layer comprising aluminum oxide particles having a specific surface area from about 5 $m^2/g$ to about 40 $m^2/g$;

a gas fill material comprising mercury disposed in the volume; and a luminescent coating disposed on the barrier coating.

* * * * *